US008137059B2

(12) United States Patent
Kim et al.

(10) Patent No.: US 8,137,059 B2
(45) Date of Patent: Mar. 20, 2012

(54) FAN GUARD AND OUTDOOR UNIT FOR AIR CONDITIONER HAVING THE SAME

(75) Inventors: Jin Baek Kim, Suwon-si (KR); Hyun Seok Jung, Yongin-si (KR); Jun Young Lee, Yongin-si (KR); Jung Hyeon Kim, Hwaseong-si (KR); Hyun Ho Park, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 894 days.

(21) Appl. No.: 12/222,452

(22) Filed: Aug. 8, 2008

(65) Prior Publication Data

US 2009/0110542 A1 Apr. 30, 2009

(30) Foreign Application Priority Data

Oct. 30, 2007 (KR) ..... 10-2007-109420

(51) Int. Cl.

| | |
|---|---|
| ***F03B 11/08*** | (2006.01) |
| ***F03B 1/00*** | (2006.01) |
| ***F01D 5/00*** | (2006.01) |
| ***F04D 29/70*** | (2006.01) |
| ***B63H 7/00*** | (2006.01) |

(52) U.S. Cl. ..... 415/121.2; 415/220; 415/119; 415/213.1; 416/247 R

(58) Field of Classification Search ..... 415/121.2, 415/220, 208.2, 119, 213.1, 125, 191, 214.1, 415/215.1; 416/247 R See application file for complete search history.

(56) References Cited

U.S. PATENT DOCUMENTS

2005/0238481 A1* 10/2005 Yamamoto et al. ..... 415/121.2

FOREIGN PATENT DOCUMENTS

JP 2003-035438 2/2003

* cited by examiner

*Primary Examiner* — Chuong A. Luu

(74) *Attorney, Agent, or Firm* — Staas & Halsey LLP

(57) ABSTRACT

An outdoor unit for an air conditioner is disclosed. The outdoor unit according to the present invention comprises a housing which has an air inlet and an air outlet, a ventilation fan rotatably mounted in the housing, and a fan guard connected to the housing to cover the air outlet. Here, the fan guard comprises a plurality of closed ribs arranged sequentially and concentrically between a center and an outline thereof, and a plurality of radial ribs arranged in radial directions to interconnect the plurality of closed ribs, in such a manner that some of the closed ribs, which are disposed at intermediate positions near tips of the ventilation fan, are at a further distance from the ventilation fan than the other closed ribs, which are disposed near the center and the outline. Accordingly, since the fan guard is convexly raised at a position corresponding to the tips of the ventilation fan, thereby guaranteeing a predetermined space between the fan guard and the tips where the airflow is fastest, the flow resistance and the flow-induced noise can be reduced.

16 Claims, 7 Drawing Sheets

FAN GUARD AND OUTDOOR UNIT FOR AIR CONDITIONER HAVING THE SAME

CROSS-REFERENCE TO RELATED APPLICATION

This application claims the benefit of Korean Patent Application No. 2007-109420, filed on Oct. 30, 2007, in the Korean Intellectual Property Office, the disclosure of which is incorporated herein by reference.

BACKGROUND OF THE INVENTION

1. Field of the Invention

The present invention relates to a fan guard and an air conditioner having the same, and more particularly to a fan guard mounted to an air outlet to shield a fan, and an outdoor unit of an air conditioner having the same.

2. Description of the Related Art

Generally, an air conditioner refers to a device that circulates air of an interior space using a refrigeration cycle. Especially a split-type air conditioner in which an indoor unit and an outdoor unit are separately installed is widely used.

The indoor unit includes an indoor heat exchanger in which a coolant is flowing, and a ventilator which forcibly blows air around the indoor heat exchanger. Such an indoor unit is installed in the interior space. The outdoor unit includes an outdoor heat exchanger in which a coolant is flowing, a compressor which compresses the coolant, and a ventilator which forcibly blows air around the outdoor heat exchanger so as to improve the heat exchanging efficiency of the coolant flowing through the outdoor heat exchanger.

The outdoor heat exchanger, the compressor, and the ventilator are mounted in and shielded by a housing. The housing includes an air inlet to draw in the outside air and an air outlet to exhaust the inside air out of the housing. The air outlet is disposed to face a ventilation fan of the ventilator. In addition, the air outlet includes a fan guard to prevent access of a human body part, such as a finger, to the ventilation fan rotating at a high speed, as well as protecting the ventilation fan and preventing infiltration of foreign substances.

FIG. 1 and FIG. 2 respectively show a conventional fan guard and part of a conventional air conditioner mounted with the same.

As shown in FIGS. 1 and 2, the conventional fan guard 11 comprises a central plate 12 disposed in the center thereof, a plurality of closed ribs 13 concentrically arranged from the central plate 12 toward the outside in sequence, and a plurality of radial ribs 14 arranged in radial directions to connect the plurality of closed ribs 13 to one another. Also, a plurality of fixing brackets 15 are formed along an outermost closed rib 13 to achieve screw-connection. Since the pluralities of closed ribs 13 and radial ribs 14 are arranged coplanarly, the above-structured conventional fan guard 11 forms a flat plane as a whole except for an outline thereof where the fixing brackets 15 are formed.

As shown in FIG. 2, the conventional fan guard 11 covers an air outlet 17 mounted to a housing 16 at a position facing a ventilation fan 18, in order to prevent infiltration of foreign substances into the housing 16, prevent breakdown of the ventilation fan 18 caused by the foreign substances, and also prevent a part of a human body from getting into the housing 16 in which the ventilation fan 18 is rotating at a high speed.

However, the conventional fan guard 11 as described above is frail due to the planar structure where the pluralities of closed ribs 13 and radial ribs 14 are arranged on one plane. In other words, the conventional fan guard 11 would be easily deformed or damaged when applied with load in a vertical direction. In order to reinforce stiffness of the conventional fan guard 11, more of the closed ribs 13 and the radial ribs 14 may be mounted. However, this will increase the manufacturing cost.

Furthermore, in the conventional fan guard 11 having the coplanar structure, the closed ribs 13 and the radial ribs 14 are disposed at a short distance from the ventilation fan 18. Therefore, resistance of airflow generated by the operation of the ventilation fan 18 and flow-induced noise are increased.

SUMMARY OF THE INVENTION

The present invention has been made in order to solve the above problems. It is an aspect of the invention to provide a fan guard capable of improving a structural stiffness thereof while decreasing flow resistance and flow-induced noise of airflow generated by the operation of a ventilation fan, and an outdoor unit of an air conditioner having the same.

Consistent with one aspect, an exemplary embodiment of the present invention provides an outdoor unit of an air conditioner, comprising a housing which has an air inlet and an air outlet, a ventilation fan rotatably mounted in the housing, and a fan guard connected to the housing to cover the air outlet, wherein the fan guard comprises a plurality of closed ribs arranged sequentially and concentrically between a center and an outline thereof, and a plurality of radial ribs arranged in radial directions to interconnect the plurality of closed ribs, in such a manner that some of the closed ribs, which are disposed at intermediate positions near tips of the ventilation fan, are at a further distance from the ventilation fan than the other closed ribs, which are disposed near the center and the outline.

A longitudinal section of the plurality of radial ribs has a curve form to be distanced from the ventilation fan at a position corresponding to the ventilation fan.

The plurality of radial ribs may comprise a plurality of main radial ribs connected to the all closed ribs; and a plurality of sub radial ribs arranged among the main radial ribs to connect part of the closed ribs.

The fan guard may comprise a fixing bracket for fixing thereof; a frame disposed at the outline to support the plurality of closed ribs and the radial ribs; and a central plate disposed at the center.

A plurality of supporting ribs may be formed between an outermost one of the plurality of closed ribs and the frame to keep the outermost closed rib at a distance from the frame so that air can pass through a gap between the outermost closed rib and the frame.

The plurality of radial ribs may comprise a plurality of inner radial ribs connecting the closed ribs disposed within a predetermined distance from the center; and a plurality of outer radial ribs connecting the closed ribs disposed beyond the predetermined distance from the center.

Consistent with another aspect, an exemplary embodiment of the present invention provides a fan guard mounted to face a ventilation fan that forcibly blows air so as to protect the ventilation fan, the fan guard comprising a plurality of closed ribs arranged concentrically and sequentially between a center and an outline thereof, and a plurality of radial ribs arranged in radial directions to interconnect the close ribs, in such a manner that some of the closed ribs, which are disposed at intermediate positions near tips of the ventilation fan, are at a further distance from the ventilation fan than the other closed ribs, which are disposed near the center and the outline.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
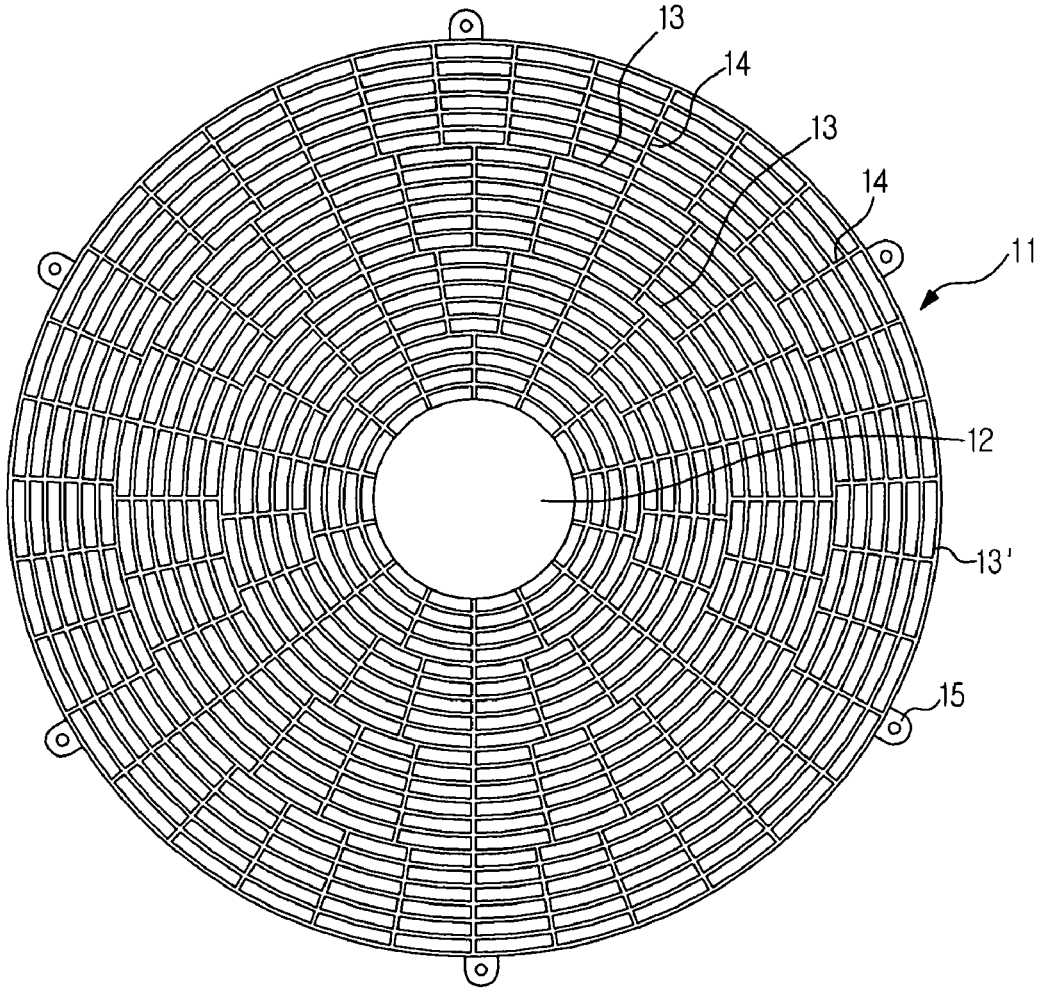
FIG. 1 is a plan view schematically showing a conventional fan guard.
Figure 2:
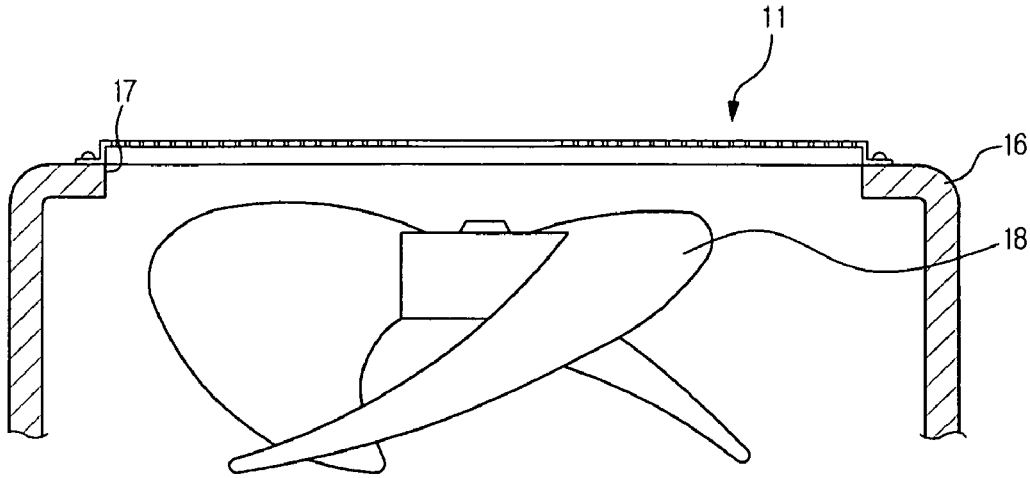
FIG. 2 is a side-sectional view showing the fan guard of FIG. 1 being mounted.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Figure 3:
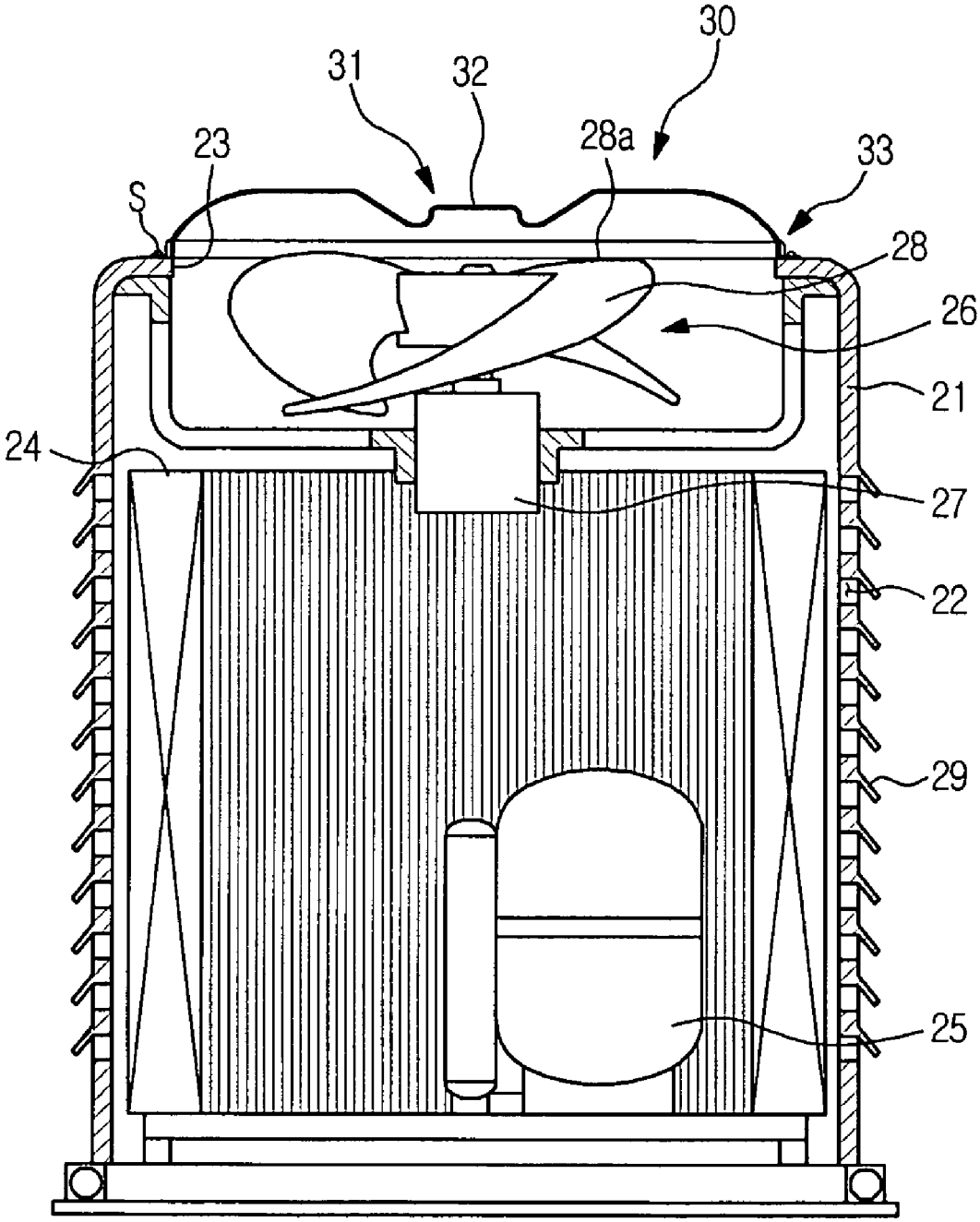
FIG. 3 is a side-sectional view schematically showing an outdoor unit of an air conditioner, according to an embodiment of the present invention.

FIG. 3 is a side-sectional view schematically showing an outdoor unit of an air conditioner, according to an embodiment of the present invention.

Referring to FIG. 3, the outdoor unit according to the embodiment of the present invention comprises a housing 21 which includes an air inlet 22 and an air outlet 23, an outdoor heat exchanger 24 mounted along an inner circumference of the housing 21, a compressor 25 mounted at an inside of the outdoor heat exchanger 24, a ventilator 26 mounted within the housing 21 adjacent to the air outlet 23, and a fan guard 30 connected to the outside of the housing 21 to cover the air outlet 23.

A plurality of the air inlets 22 are formed on a lateral surface of the housing 21. A louver 29 is mounted around the air inlets 22 formed at the outside of the housing 21 to prevent foreign substances from infiltrating through the air inlets 22. The air outlet 23 is mounted to an upper part of the housing 21.

The ventilator 26 is mounted to a lower part of the air outlet 23 to forcibly 5 exhaust air from the inside of the housing 21. The ventilator 26 comprises a ventilation fan 28, and a fan motor 27 rotating the ventilation fan 28. When the ventilation fan 29 is rotated by the fan motor 27, the outside air of the housing 21 is drawn into the housing 21 through the air inlets 22. The air drawn in through the air inlets 22 is passed through the outdoor heat exchanger 24 in a direction from the outside to the inside. While passing through the outdoor heat exchanger 24, heat exchange is performed with the air. The air drawn into the outdoor heat exchanger 24 is then exhausted to the outside through the air outlet 23.

The fan guard 30 covers the air outlet 23, thereby protecting the inside of the housing 21 from foreign substances and accordingly preventing damage of the 15 ventilation fan 28 by foreign substances. Also, the fan guard 30 functions as a protection net which prevents entry of a human body part into the housing 21 through the air outlet 23 because the ventilation fan 28 is rotating at a high speed in the housing 21.

Figure 4:
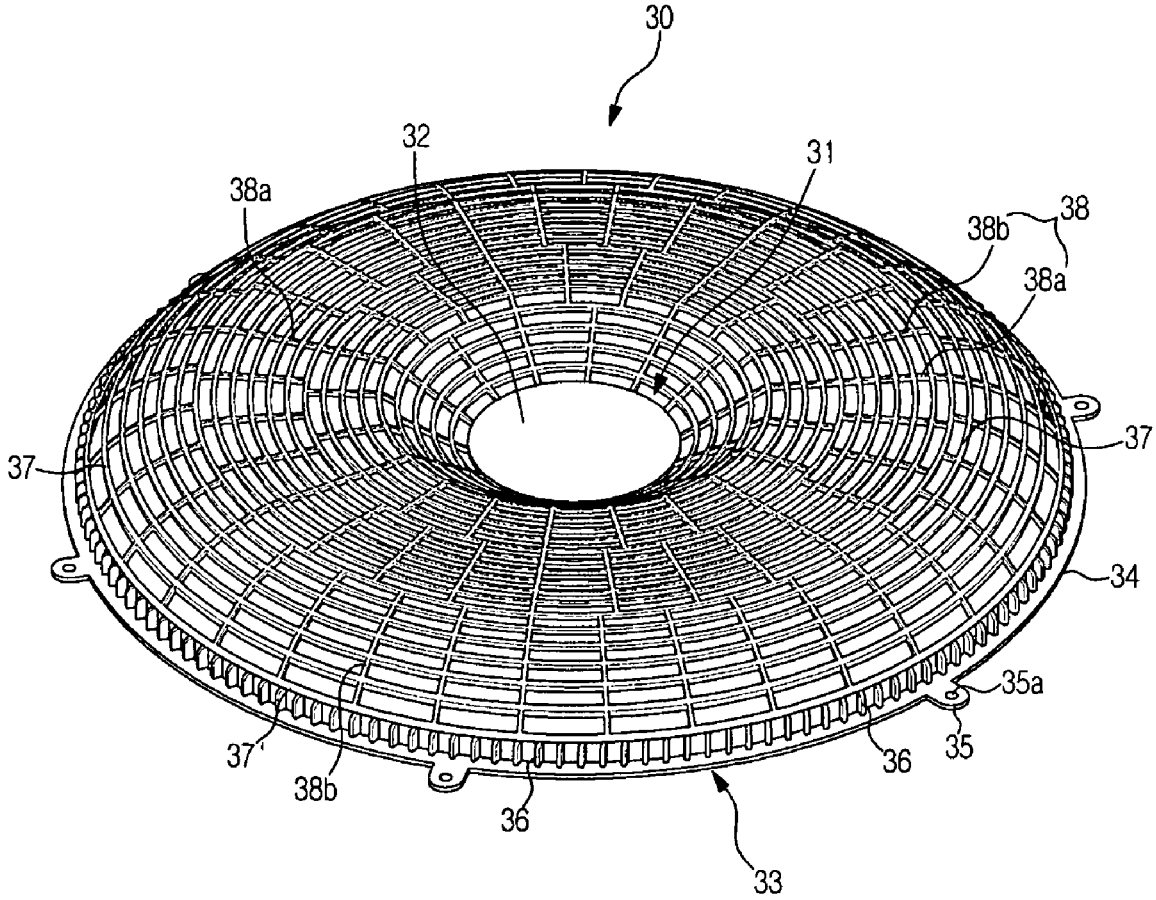
FIG. 4 is a perspective view schematically showing a fan guard mounted to the outdoor unit of the air conditioner shown in FIG. 3.

As shown in FIG. 4, the fan guard 30 comprises a central plate 32 disposed in a center 31 thereof, a frame 34 formed around an outline 33 thereof, a plurality of closed ribs 37 concentrically arranged between the center 31 and the outline 33 in sequence, and a plurality of radial ribs 38 arranged in radial directions to connect the plurality of closed ribs 37 to one another.

In the above-structured fan guard 30 according to the embodiment of the present invention, while the central plate 32 has a disc form, the plurality of closed ribs 37 and the frame 34 have an annular form having respectively different diameters. However, the fan guard 30 of the present invention is not limited to the disc form, but may adopt other various forms.

A plurality of fixing brackets 35 may be arranged around an outline of the frame 34 at uniform intervals. Each of the fixing brackets 35 has a screw hole 35*a* allowing insertion of a screw S. The fan guard 30 can be fixed to the housing 21 through screw-connection of the fixing brackets 35 to the housing 21.

The plurality of closed ribs 37 are in the form of concentric circles arranged at uniform intervals between the central plate 32 and the frame 34. The interval between the respective adjacent closed ribs 37 is set not to allow passage of a human finger. Some of the closed ribs 37 disposed at intermediate positions in the vicinity of tips 28*a* of the ventilation fan 28 are disposed higher than the other closed ribs 37 disposed in the vicinity of the center 31 and the outline 33. By thus structuring the intermediate closed ribs 37 in the vicinity of the tips 28*a* to be at a greater distance from the other closed ribs 37, a predetermined space can be guaranteed between the fan guard 30 and the tips 28*a* of the ventilation fan 28 where the airflow is fastest, thereby reducing the flow resistance of the airflow and the flow-induced noise.

An outermost closed rib 37' among the plurality of closed ribs 37 is connected with a plurality of supporting ribs 36 protruded on the frame 34 at uniform intervals. Therefore, the outermost closed rib 37' and the frame 34 are spaced apart from each other, so that the air can be exhausted through a gap between the outermost closed rib 37' and the frame 34. Thus, the plurality of supporting ribs 36 not only support the outermost closed rib 37' against the frame 34 but also reduces the flow resistance of the exhausted air.

The plurality of radial ribs 38 are arranged between the frame 34 and the central plate 32 according to a predetermined pattern. More specifically, the plurality of radial ribs 38 are divided into a plurality of main radial ribs 38*a* extending from the central plate 32 up to the outermost closed rib 37', accordingly being connected to all the closed ribs 37, and a plurality of sub radial ribs 38*b* arranged between the main radial ribs 38*a* to connect the closed ribs 37 in sub portions. The main radial ribs 38*a* may be arranged at uniform intervals to support all the closed ribs 37. In addition, the sub radial ribs 38*b* are arranged among the main radial ribs 38*a* to improve stiffness of the fan guard 30. The number of the sub radial ribs 38*b* may increase from the center 31 toward the outline 33. Since the closed ribs have greater lengths near the outline 33 than near the center 31, more sub radial ribs 38*b* are may be used toward the outline 33 in order to keep uniform or even similar intervals among the radial ribs 38.

The plurality of main radial ribs 38*a* may have a curve form which is convex at a position corresponding to the ventilation fan 28 to be distanced from the ventilation fan 28. The sub radial ribs 38*b* are also curved corresponding to the main radial ribs 38*a*.

Figure 5:
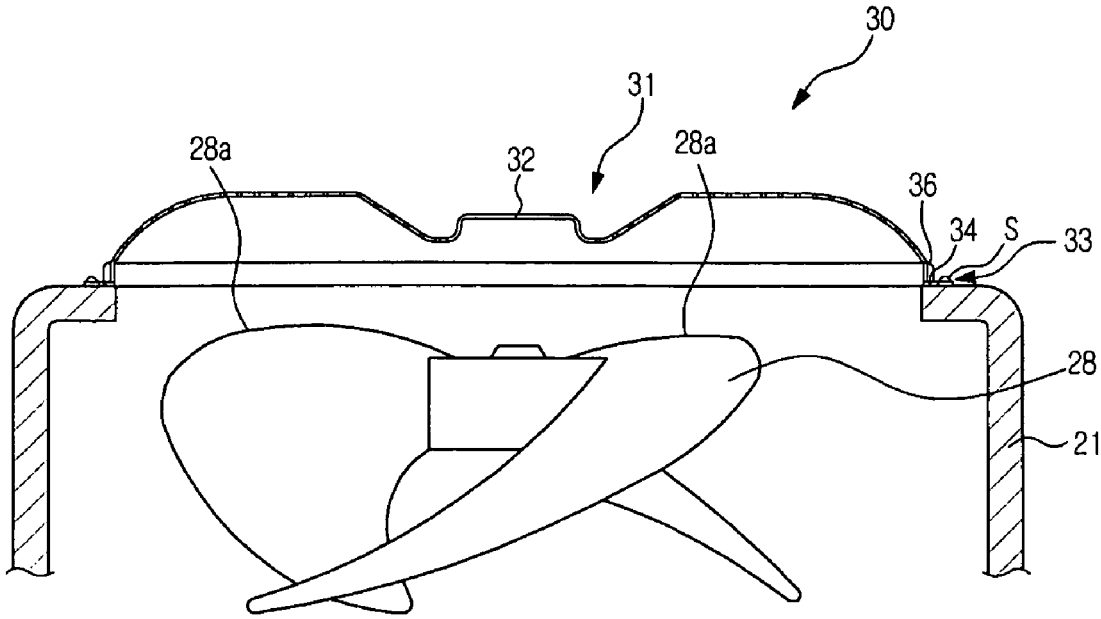
FIG. 5 is a side-sectional view extracting a part of the outdoor unit of the air conditioner shown in FIG. 3, where the fan guard is mounted.

As a result, as shown in FIG. 5, a longitudinal section of the fan guard 30 has a bow shape having a greatest height at a position corresponding to the tips 28*a* of the ventilation fan 28. Therefore, the fan guard 30 according to the embodiment of the present invention has an excellent vertical stiffness and is improved in robustness not to be easily deformed or damaged compared to a conventional coplanar fan guard. Additionally, since the fan guard 30 according to the embodiment of the present invention has a superior stiffness to the conventional fan guard, given that stiffness of a conventional fan is satisfactory, the material cost can be saved by reducing the number of either or both of the closed ribs 37 and radial ribs 38. In addition, the flow resistance and the flow-induced noise can be reduced.

Figure 6:
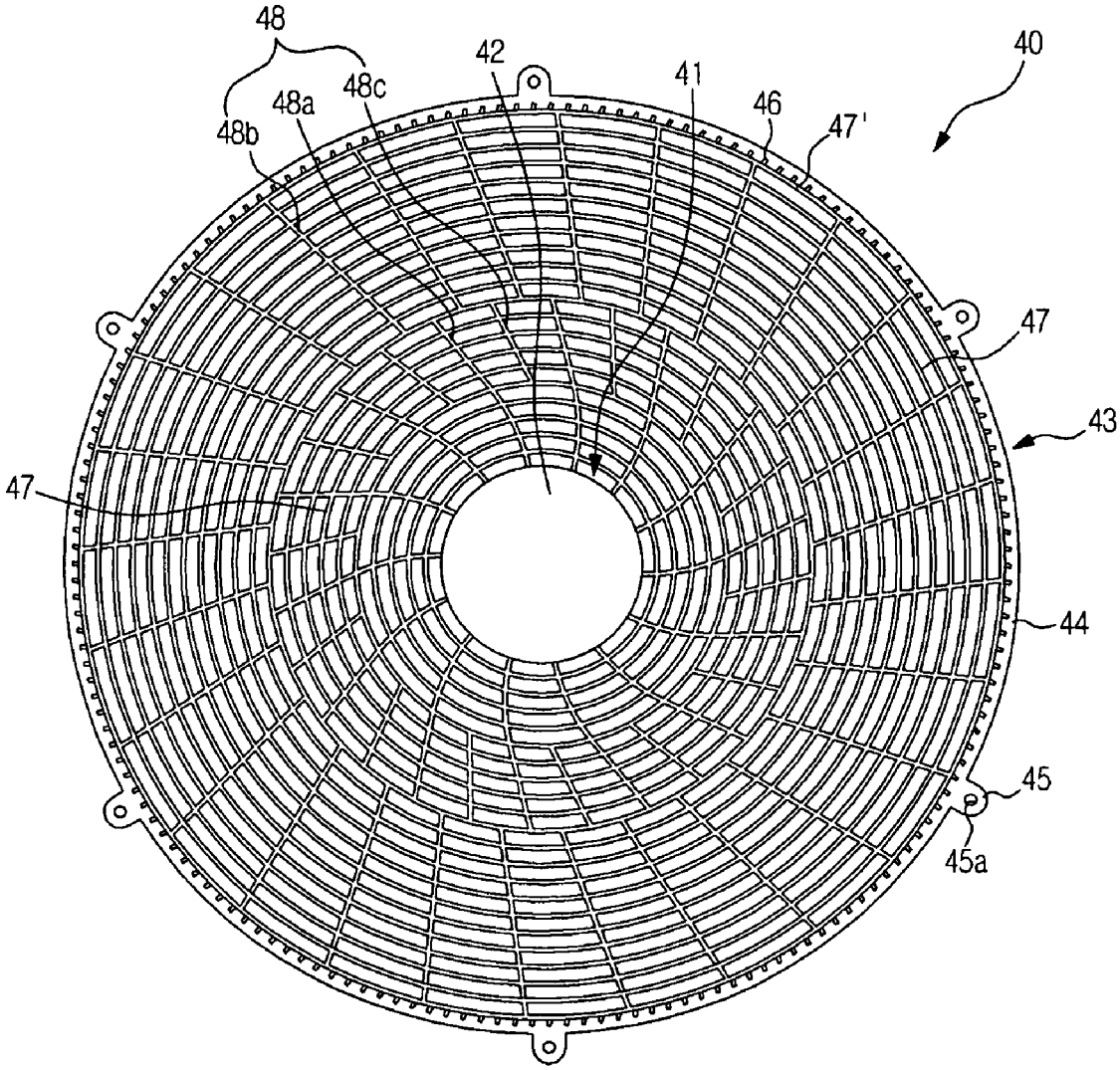
FIG. 6 is a plan view schematically showing a fan guard according to another embodiment of the present invention.
Figure 7:
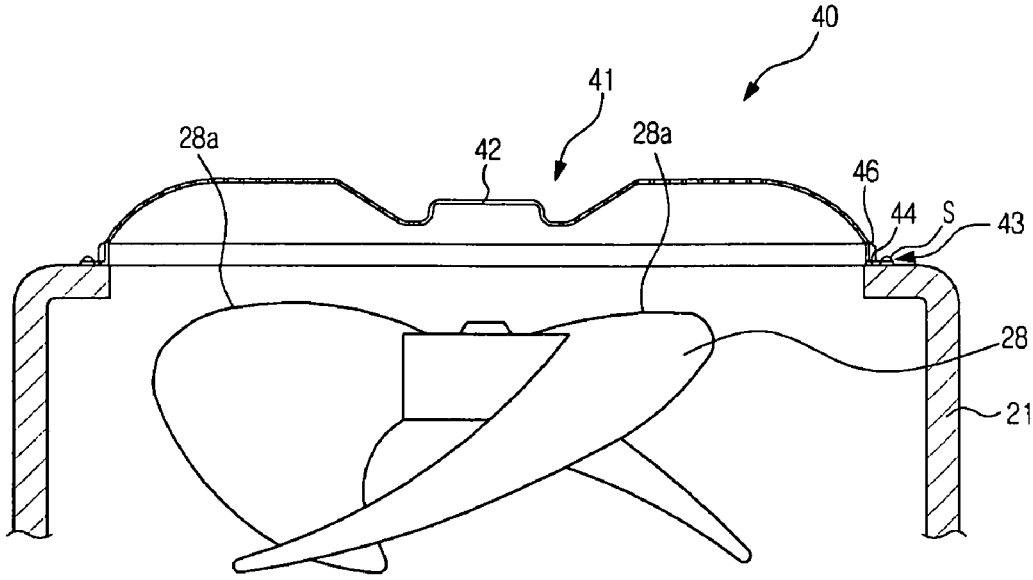
FIG. 7 is a side-sectional view showing a mounting state of the fan guard of FIG. 6.

FIG. 6 and FIG. 7 are showing a fan guard according to another embodiment of the present invention, and the fan guard mounted to the outdoor unit of the air conditioner.

A fan guard 40 according to another embodiment of the present invention has substantially the same structure as the fan guard 30 of the previous embodiment. The fan guard 40 comprises a frame 44 having an annular form fixed to the housing 21, a central plate 42 disposed in the center of the frame 44, a plurality of closed ribs 47 concentrically and sequentially arranged between the frame 44 and the central plate 42, and a plurality of radial ribs 48 arranged in radial directions to connect the plurality of closed ribs 47 to one another.

The frame 44 includes a plurality of fixing brackets 45 each having a screw hole 45*a*, and a plurality of supporting ribs 46 arranged on an upper surface thereof at uniform intervals to support an outermost closed rib 47'.

The plurality of closed ribs 47 are in the form of concentric circles arranged at uniform intervals not allowing passage of a human finger. Some of the closed ribs 47 disposed at intermediate positions in the vicinity of tips 28*a* of the ventilation fan 28 are disposed higher than the other closed ribs 47 disposed in the vicinity of a center 41 and an outline 43.

The plurality of radial ribs 48 comprise a plurality of inner radial ribs 48*a* connecting some of the closed ribs 47, which are disposed within a predetermined distance from the center 41, and a plurality of outer radial ribs 48*b* connecting the rest of the closed ribs 47, which are disposed beyond the predetermined distance from the center 41. Here, since the closed ribs 47 disposed near the outline 43 have greater lengths than the closed ribs 47 near the center 41, the more number of the outer radial ribs 48*b* may be needed than the inner radial ribs 48*a* in order to reinforce the structure near the outline 43. Additionally, a plurality of sub radial ribs 48*c* are formed among the inner radial ribs 48*a* to connect some of the closed ribs 47 which are disposed at intermediate positions. The intermediate part between the center 41 and the outline 43 has a relatively frail structure since it is disposed at a distance from the frame 44 fixed to the housing 21 and due to relatively wider intervals among the radial ribs 48 than near the center 41. Therefore, the sub radial ribs 48*c* may be provided to reinforce the stiffness at the intermediate part.

As shown in FIG. 6, the plurality of radial ribs 48 are spirally curved from the center 41 toward the outline 43. Additionally, as shown in FIG. 7, a longitudinal section between the center 41 and the outline 43 is convex in a direction of being distanced from the ventilation fan 28.

As described above, the fan guard 40 according to another embodiment of the present invention has a bow-like longitudinal sectional shape, as well as the fan guard according to the previous embodiment. Accordingly, the vertical stiffness can be improved. Also, since a predetermined space is guaranteed between the fan guard 40 and the tips 28*a* of the ventilation fan 28 where the airflow is fastest, the flow resistance and the flow-induced noise can be reduced.

The fan guards 30 and 40 according to the embodiments of the present invention can be made in an integrated form by injection molding of plastic. However, other manufacturing methods and materials may be applied.

Furthermore, the fan guards 30 and 40 may be applied to any other machines requiring the ventilator 26, besides the outdoor unit of the air conditioner.

As can be appreciated from the above description, the fan guard according to the present invention is convexly raised at a position corresponding to the tips of the ventilation fan, thereby guaranteeing a predetermined space between the tips and the fan guard. Accordingly, the flow resistance of the airflow and the flow-induced noise can be reduced.

Moreover, the fan guard according to the present invention can be improved in stiffness since having the bow-like longitudinal sectional shape.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An outdoor unit of an air conditioner, comprising a housing which has an air inlet and an air outlet, a ventilation fan rotatably mounted in the housing, and a fan guard connected to the housing to cover the air outlet, wherein the fan guard comprises a plurality of closed ribs arranged sequentially and concentrically between a center and an outline thereof, and a plurality of radial ribs arranged in radial directions to interconnect the plurality of closed ribs, in such a manner that some of the closed ribs, which are disposed at intermediate positions near tips of the ventilation fan, are at a further distance from the ventilation fan than the other closed ribs, which are disposed near the center and the outline, wherein a longitudinal section between the center and the outline of the fan guard has a curve form to be curved in the opposite direction to the ventilation fan.

2. The outdoor unit according to claim 1, wherein the longitudinal section of the plurality of radial ribs has a curve form to be distanced from the ventilation fan at a position corresponding to the ventilation fan.

3. The outdoor unit according to claim 2, wherein the plurality of radial ribs comprises:

a plurality of main radial ribs connected to the all closed ribs; and a plurality of sub radial ribs arranged among the main radial ribs to connect part of the closed ribs.

4. The outdoor unit according to claim 1, wherein the fan guard comprises:

a fixing bracket for fixing thereof;

a frame disposed at the outline to support the plurality of closed ribs and the radial ribs; and a central plate disposed at the center.

5. The outdoor unit according to claim 4, wherein a plurality of supporting ribs are formed between an outermost one of the plurality of closed ribs and the frame to keep the outermost closed rib at a distance from the frame so that air can pass through a gap between the outermost closed rib and the frame.

6. The outdoor unit according to claim 1, wherein the plurality of radial ribs comprise:

a plurality of inner radial ribs connecting the closed ribs disposed within a predetermined distance from the center; and a plurality of outer radial ribs connecting the closed ribs disposed beyond the predetermined distance from the center.

7. A fan guard mounted to face a ventilation fan that forcibly blows air so as to protect the ventilation fan, the fan guard comprising a plurality of closed ribs arranged concentrically and sequentially between a center and an outline thereof, and a plurality of radial ribs arranged in radial directions to interconnect the closed ribs, in such a manner that some of the closed ribs, which are disposed at intermediate positions near tips of the ventilation fan, are at a further distance from the ventilation fan than the other closed ribs, which are disposed near the center and the outline, wherein a longitudinal section between the center and the outline of the fan guard has a curve form to be curved in the opposite direction to the ventilation fan.

8. The fan guard according to claim 7, wherein the longitudinal section of the plurality of radial ribs has a curve form to be distanced from the ventilation fan at a position corresponding to the ventilation fan.

9. The fan guard according to claim 8, wherein the plurality of radial ribs comprises:

a plurality of main radial ribs connected to the all closed ribs; and a plurality of sub radial ribs arranged among the main radial ribs to connect part of the closed ribs.

10. The fan guard according to claim 7, wherein the fan guard comprises:

a fixing bracket for fixing thereof;

a frame disposed at the outline to support the plurality of closed ribs and the radial ribs; and a central plate disposed at the center.

11. The fan guard according to claim 10, wherein a plurality of supporting ribs are formed between an outermost one of the plurality of closed ribs and the frame to keep the outermost closed rib at a distance from the frame so that air can pass through a gap between the outermost closed rib and the frame.

12. The fan guard according to claim 7, wherein the plurality of radial ribs comprise:

a plurality of inner radial ribs connecting the closed ribs disposed within a predetermined distance from the center; and a plurality of outer radial ribs connecting the closed ribs disposed beyond the predetermined distance from the center.

13. The fan guard according to claim 12, wherein at least some of the plurality of inner radial ribs are in a spiral shape.

14. The fan guard according to claim 12, wherein the inner radial ribs and the outer radial ribs are aligned in a discontinuous line.

15. The fan guard according to claim 9, wherein the sub radial ribs are aligned in a discontinuous line.

16. The fan guard according to claim 7, wherein the radial ribs are generally in a convex shape.

* * * * *